United States Patent [19]

Furuya

[11] 4,220,169

[45] Sep. 2, 1980

[54] APPARATUS IN A COIN PACKAGING MACHINE FOR TREATING COINS WHICH ARE ACCUMULATED OUT OF ALIGNMENT

[75] Inventor: Katusuke Furuya, Tokyo, Japan

[73] Assignee: Laurel Bank Machine Co., Ltd., Tokyo, Japan

[21] Appl. No.: 946,032

[22] Filed: Sep. 26, 1978

[51] Int. Cl.[2] ..... G07D 9/06

[52] U.S. Cl. ..... 133/8 A

[58] Field of Search ..... 133/1 A, 8 A, 8 D; 53/159

[56] References Cited

U.S. PATENT DOCUMENTS

| | | | |
|---|---|---|---|
| 4,123,892 | 11/1978 | Asami | 133/1 A |
| 4,128,102 | 12/1978 | Asami et al. | 133/1 A |

*Primary Examiner*—Stanley H. Tollberg

*Attorney, Agent, or Firm*—Fleit & Jacobson

[57] ABSTRACT

An apparatus in a coin packing machine for treating coins which are accumulated out of alignment, characterized in that, when a detector detects that the coins accumulated in a cartridge of a coin packing machine are out of alignment at a predetermined moment of time, a cam-driving shaft for driving a packing mechanism which is in an operative state at said moment of time is caused to turn in a reverse direction by a detected signal, whereby said detector is allowed to further continue the operation of detecting non-alignment, and when the non-alignment is eliminated during the operation in the reverse direction, the cam-driving shaft is caused to turn again in the forward direction to perform the packing operation, and when the non-alignment is not eliminated, said cam-driving shaft is caused to return to the initial position so that the operation of the machine is stopped.

1 Claim, 7 Drawing Figures

APPARATUS IN A COIN PACKAGING MACHINE FOR TREATING COINS WHICH ARE ACCUMULATED OUT OF ALIGNMENT

BACKGROUND OF THE INVENTION

1. Field of the Invention

The present invention relates to an apparatus in a coin packing machine for treating coins which are accumulated out of alignment.

2. Prior Art

In the conventional coin packing machines, when a predetermined number of coins continuously supplied into a cartridge were accumulated in the form of a rod, the accumulation of the coins was delivered into a packing mechanism where the accumulation of coins was automatically packaged. The coins often fell in an irregular manner and accumulated in the cartridge, whereby the coins tilted as shown in FIG. 2 were frequently stacked out of alignment.

With the conventional machines, when the non-alignment of the coins was not corrected, even after a predetermined moment of time has passed, a detector detected the presence of non-alignment, and the detected signal caused a cam-driving shaft for driving a packaging mechanism, which was already starting rotation, to be actuated in a reverse direction until the initial position was reached, thereby halting the operation of the machine. That is, once a non-alignment signal was produced at a predetermined moment of time, the machine was caused to come to a halt even when the non-alignment of coins was corrected during the turn of the cam-driving shaft in the reverse direction.

Accordingly, the operation button had to be manipulated by human hand to resume the operation, resulting in poor operation efficiency.

SUMMARY OF THE INVENTION

The present invention is provided in order to overcome the abovementioned deficiencies. According to the present invention, the coins stacked out of alignment are monitored by a detector even when the cam-driving shaft is rotating in the reverse direction, and if the non-alignment is removed during that moment before the machine comes into halt, the cam-driving shaft is immediately caused to turn in the forward direction to continue the packing operation.

DETAILED DESCRIPTION OF THE PREFERRED EMBODIMENTS

The invention is illustrated below with reference to an embodiment in conjunction with the accompanying drawings.

Figure 1:
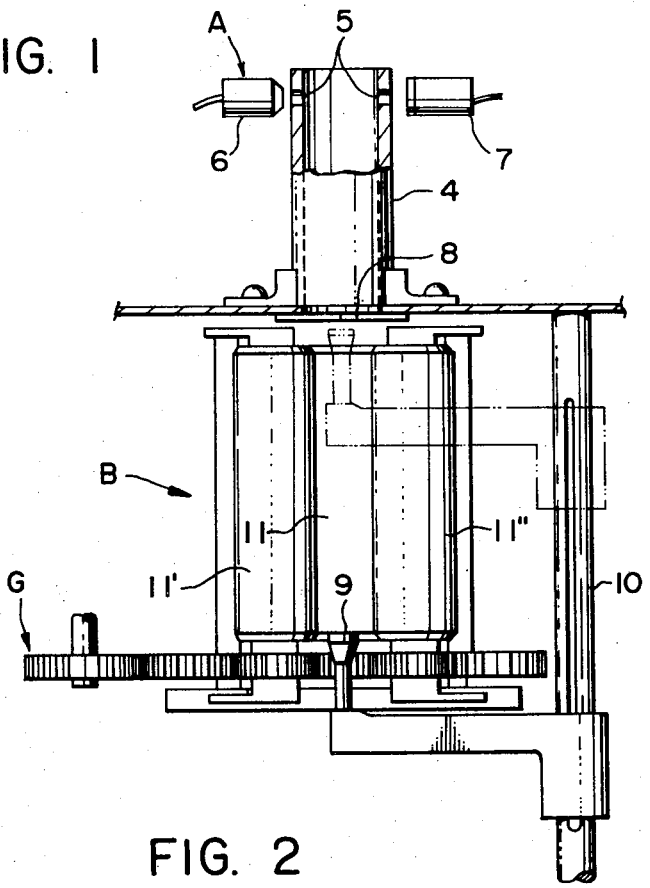
FIG. 1 is a side view showing a portion of a coin packaging machine.
Figure 3:
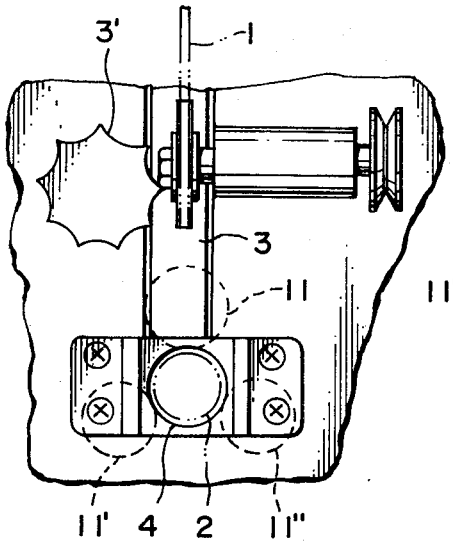
FIG. 3 is a plan view showing an upper portion of cartridge.

A counter 3' (FIG. 3) is provided at a rear side of a path 3 for sorting coins 2, on which upper side is disposed a conveyor belt 1. A cylindrical cartridge 4 is provided in a vertical manner at the rear and lower side of the sorting path 3. A photoelectric detector A (FIG. 1) consisting of a light projector 6 and a light receiver 7 is provided to correspond to a through hole 5 formed in a lateral direction at an upper portion of the cartridge 4, and on the lower portion of the cartridge 4 is provided a shutter 8 consisting of two plates that are designed to open in two directions.

Figure 4:
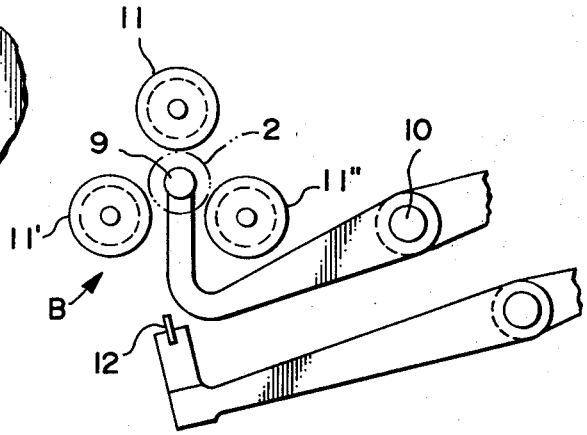
FIG. 4 is a plan view showing a portion of FIG. 1.

Underneath the shutter 8 is installed a packaging portion B. The packaging portion B has a coin receiver 9 which is located beneath the shutter 8 and which is allowed to move in the upper and lower directions along a guide shaft 10. Three packaging rollers 11, 11' and 11" are studded at three equally divided positions around the coin receiver 9, are allowed to move by means of a lower link and are rotated by means of a gear train G. The three packaging rollers 11, 11' and 11" are pressed onto the accumulation of coins 2 falling through space defined by them. A packaging paper is wound on the coins while they are being rotated, and crimping pawls 12 (FIG. 4) crimp both ends of the packaging paper from the upper and lower directions to make a package, as done conventionally.

Figure 5:
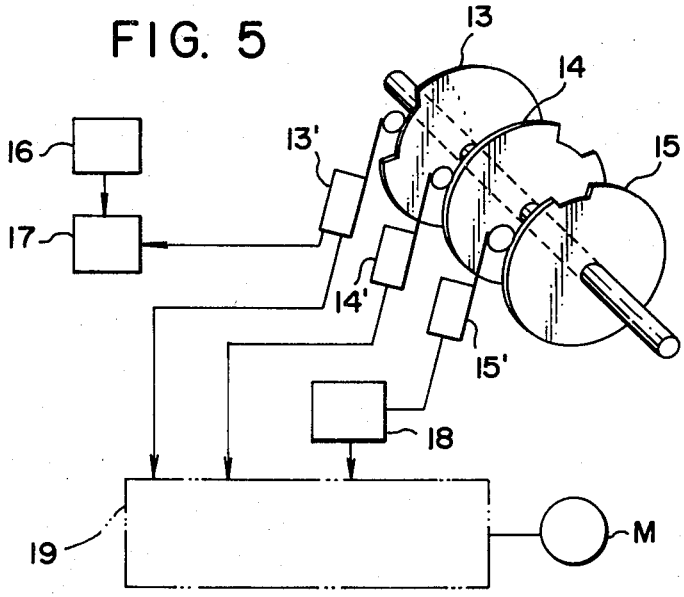
FIG. 5 is a block diagram of a portion of a driving portion for package.

FIG. 5 is a block diagram showing a portion of a driving unit of the packaging portion B, in which reference numeral 13 represents a one-revolution cam which rotates through one revolution and stops, 14 a cam for opening the shutter 8 under normal conditions, and 15 a cam for detecting the non-alignment, while reference numerals 13', 14' and 15' denote microswitches, 16 a counter circuit, 17 an electromagnetic clutch, 18 a non-alignment detector circuit, 19 a control circuit, and symbol M a packaging motor.

Figure 6:
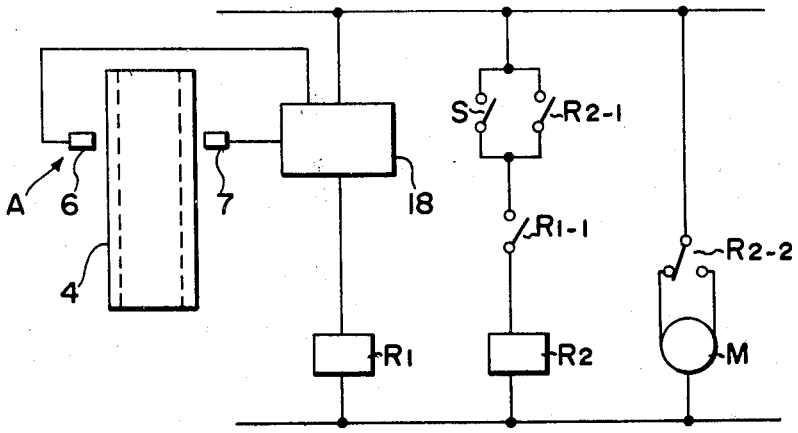
FIG. 6 is a circuit diagram according to an embodiment of the present invention.

FIG. 6 is a circuit diagram showing an important portion of the present invention, in which symbol $R_1$ denotes a relay for detecting non-alignment, $R_2$ a relay for keeping the non-alignment, S (which corresponds to the microswitch 15' in FIG. 5) a non-alignment detector switch that will be actuated by the non-alignment detector cam 15, $R_{1-1}$ a contact of the non-alignment detector relay $R_1$, and symbols $R_{2-1}$ and $R_{2-2}$ contacts of the relay $R_2$ for keeping the non-alignment.

When a power supply is turned on, and a start button is pushed, the packaging motor M and a counter motor (not shown) start to operate in the forward direction. As the coins 2 counted by the counter 3' and falling on the cartridge 4 are accumulated properly to a predetermined number, the counter circuit 16 produces a count completion signal which is fed to the electromagnetic clutch 17 which mechanically connects the packaging motor M to the shafts of each of the abovesaid cams, so that the cams 13, 14 and 15 are caused to rotate in the counter-clockwise direction, as seen in FIG. 5.

That is, the packaging motor M rotates in the forward direction, and the shutter 8 is opened responsive to the timing of the cam 14. The coins 2 in the cartridge 4 are allowed to fall on the coin receiver 9 which is moved upwardly as indicated by imaginary lines in FIG. 1. The rollers 11, 11' and 11" then work to wind the packaging paper on the accumulation of coins 2 which is lowered in accompaniment to the lowering motion of the coin receiver 9, and the upper and lower portions thereof are crimped by means of the crimping pawls 12 in the same manner as done conventionally.

Figure 2:
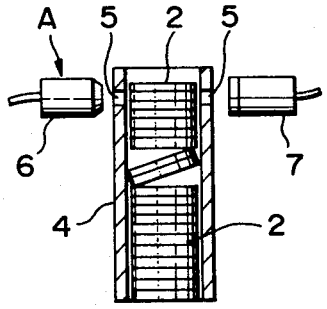
FIG. 2 is a cross-sectional view showing a portion of cartridge.

Here, if an electric current is caused to flow into a clutch which transmits the power of the packaging motor M to the packaging cam, thereby causing the packaging cam to move so as to be ready to detect the non-alignment like the conventional system, the microswitch S for detecting the non-alignment is actuated. In this case, if the coins are out of alignment as shown in FIG. 2, the light from the light projector 6 of the detector A is interrupted by the coins 2 and does not reach the light receiver 7. The circuit 18 for detecting the non-alignment is then actuated to cause electric current to flow to the relay $R_1$ for detecting the non-alignment. The electric current then flows through the switch S for detecting the non-alignment, and the contact $R_{1-1}$ of the relay $R_1$ for detecting the non-alignment, and flows into the relay $R_2$ for keeping the non-alignment, whereby the non-aligned state is maintained by the contact $R_{2-1}$ of the relay $R_2$ for keeping the non-alignment even after the signal of the switch S for detecting the non-alignment has been extinguished during the period of rotation in the reverse direction.

As the electric current flows into the relay $R_2$ for keeping the non-alignment, the packaging motor M is rotated in the reverse direction due to the contact $R_{2-2}$ of the relay $R_2$ for keeping the non-alignment, whereby the packaging cam is rotated in the reverse direction (or clockwise direction as seen in FIG. 5).

While the packing cam is rotating in the reverse direction, a conventionally employed vibrator which is not shown here gives vibration so that the non-alignment shown in FIG. 2 is extinguished. Therefore, no electric current flows into the relay $R_1$ for detecting the non-alignment. The contact $R_{1-1}$ of the relay $R_1$ for detecting the non-alignment is separated, the relay $R_2$ for keeping the non-alignment is released, the self-retaining function of the relay $R_2$ is released. Accordingly, the packaging motor M is allowed to rotate in the forward direction due to the contact $R_{2-2}$ of the relay $R_2$ for keeping the non-alignment, the coins 2 are packaged as mentioned in the foregoing, the packaging cam is turned once, and the accumulation of coins 2 is packaged by the packaging paper in the form of a cylinder.

Figure 7:
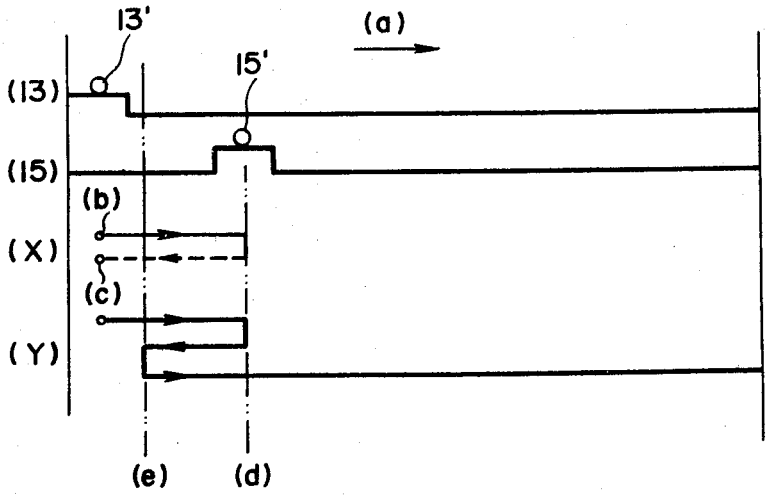
FIG. 7 is a diagram for comparison.

A prior art arrangement and the present invention are illustrated below with reference to the diagram of comparison shown in FIG. 7. Under the condition in which the cam 13 which rotates through one revolution and stops, and the cam 15 for detecting the non-alignment, are rotating in the forward direction as indicated by arrow (a), and in which the microswitches 13' and 15' make the circuit, the cam shaft according to the prior art was started to turn from the point (b) by means of the electromagnetic clutch as shown by (X), and was caused to rotate in the reverse direction from the point (d) at which the non-alignment was detected. The rotation in the reverse direction was continued even after the point (e) at which the non-alignment was eliminated was reached; the cam shaft was returned to the position (c) at which the cam completed one revolution and stopped, thereby to stop the operation of the machine. According to the present invention, on the other hand, the cam shaft is caused to return to the point (d) until the point (e) is reached, and where the cam shaft is caused to turn in the forward direction, again to resume the packaging operation as shown by (Y).

In the way, according to the present invention, the non-alignment of coins is detected even when the packaging cam is rotated in the reverse direction, in order to minimize the need of stopping the packaging machine as caused by the non-aligned coins and, eventually, to perform the operation of packaging the coins efficiently.

What is claimed is:

1. An apparatus in a coin packaging machine for treating coins which are accumulated in a cartridge out of alignment, comprising:

a reversible motor having forward and reverse directions of rotation, a cam driving shaft capable of being connected with said reversible motor, means for connecting said reversible motor to said cam driving shaft when a predetermined number of coins is accumulated in the cartridge of the coin packaging machine, a non-alignment detecting cam mounted on said cam driving shaft, a switch actuated by said non-alignment detecting cam, means for detecting non-alignment of the coins accumulated in the cartridge, first circuit means for rotating said reversible motor in the reverse direction as non-alignment of the coins is detected and said switch is acutated, and for maintaining the reverse rotation of said reversible motor, and second circuit means for rotating said motor in the forward direction as non-alignment of the coins is eliminated during the reverse rotation of said reversible motor.

* * * * *